US006851544B2

(12) United States Patent
Noll, Jr.

(10) Patent No.: US 6,851,544 B2
(45) Date of Patent: Feb. 8, 2005

(54) TRANSFER DEVICE

(75) Inventor: Harry C. Noll, Jr., Whitehall, PA (US)

(73) Assignee: Graphic Management Associates, Inc., Bethlehem, PA (US)

( * ) Notice: Subject to any disclaimer, the term of this patent is extended or adjusted under 35 U.S.C. 154(b) by 0 days.

(21) Appl. No.: 10/440,880

(22) Filed: May 19, 2003

(65) Prior Publication Data

US 2004/0231962 A1 Nov. 25, 2004

(51) Int. Cl.[7] ..... B65G 25/00
(52) U.S. Cl. ..... 198/470.1; 198/478.1
(58) Field of Search ..... 198/470.1, 478.1, 198/644

(56) References Cited

U.S. PATENT DOCUMENTS

| | | | | |
|---|---|---|---|---|
| 3,649,004 | A | 3/1972 | Fels et al. | |
| 3,703,281 | A | 11/1972 | Liebert et al. | |
| 4,201,286 | A | 5/1980 | Meier | |
| 4,555,101 | A | 11/1985 | Stobb | |
| 4,577,855 | A | 3/1986 | Reist | |
| 4,953,847 | A | 9/1990 | Honegger | |
| 5,218,813 | A | 6/1993 | Seidel | |
| 5,388,820 | A | 2/1995 | Eberle et al. | |
| 5,395,151 | A | 3/1995 | Eberle | |
| 5,494,274 | A | 2/1996 | Hansch | |
| 5,653,432 | A | 8/1997 | Hansch | |
| 5,758,872 | A | 6/1998 | Seidel et al. | |
| 6,182,960 | B1 * | 2/2001 | Keller et al. | 198/470.1 |
| 6,196,538 | B1 * | 3/2001 | Stauber et al. | 198/470.1 |
| 6,672,447 | B2 * | 1/2004 | Muller | 198/478.1 |

* cited by examiner

*Primary Examiner*—James R. Bidwell
(74) *Attorney, Agent, or Firm*—Muserlian, Lucas and Mercanti

(57) ABSTRACT

The transfer device is a circular conveyor having a plurality of radially moveable grippers. The grippers receive a non-self-supporting package, such as a newspaper jacket, on its bottom edge from an overhead line conveyor and rotate the newspaper down onto a receiving device such as a bundler at the bottom of the drum's rotation. The transfer device controls the gripping of the newspaper from the line conveyor with an inhibitor cam to provide a controlled bypass mechanism. The radial moveable grippers allow for smoother transistion and decrease space needs.

6 Claims, 7 Drawing Sheets

TRANSFER DEVICE

BACKGROUND OF THE INVENTION

1. Field of the Invention

The present Invention relates to a device for transferring flat, flexible, non-self-supporting printed products from a line conveyor to a receiving device like a conveyor or a bundler. The present Invention is especially useful for handling newspapers.

2. Art Relating to the Invention

In the graphic arts industry, flat, flexible, non-self-supporting printed products, such as newspapers and magazines, are moved by line conveyors. At some point along their path, the product has to be transferred from the line conveyor to another conveyor, a bundler, or other type of receiving device for further processing a stacker. The bundler/stacker prepares stacks of product for shipment, future binding, handling, or processing.

Typically, a line conveyor, as employed in the graphic arts industry, is a horizontally oriented endless chain which is equipped with a plurality of vertically oriented grippers. The grippers clamp the top edge of the product and transports the product to the receiving device. When the product arrives at the receiving device, the gripper opens its jaws to allow the product to fall from the gripper onto another conveyor, a platform or stack of other products, depending on the type of receiving device to which the product is transferred to at the transfer point.

One of the transfer devices used with bundlers/stackers as taught in U.S. Pat. No. 5,218,813 uses a circular conveyor which transfers the product from the line conveyor to the bundler/stacker. The circular conveyor employs grippers which grip the bottom edge of the product and rotate the product around to the bundler/stacker.

There is a point in time, just prior to release of the product from the line conveyor gripper, when the product is held by both the line conveyor gripper and the circular conveyor gripper. At this point in time, the product is subject to forces in opposite directions which can lead to problems in transferring the product from one conveyor to the other.

Additionally, there are times when the product is intended for a subsequent bundler/stacker and the line conveyor gripper does not release the product. In this situation, the circular conveyor grippers pulls the product out of the jaws of the line conveyor grippers. There is a need to avoid the fight between the line conveyor grippers and the circular conveyor grippers.

SUMMARY OF THE INVENTION

It has now been discovered that, by employing a circular conveyor with each circular conveyor gripper having both radial and circular motion, that a smooth transition of the product occurs between the line conveyor gripper and the circular conveyor gripper. The grippers of the circular conveyor gripper receive the product directly from the jaws of the line conveyor gripper and move the product to deposit it directly to a receiving device. Radial movement is suitably provided by mounting each circular conveyor gripper on a slide which moves the gripper in a radial direction with respect to the rotation of the circular conveyor.

The circular conveyor grippers of the present Invention are conventional grippers wherein the jaws are spring biased in a closed position and cams are used to open the jaws. Opening cams, positioned at the top and bottom of the rotational path of the circular conveyor, are employed for opening the circular conveyor grippers using a conventional cam follower which is mounted on one of the jaws of the circular conveyor gripper. The top opening cams are employed for opening the circular conveyor gripper to receive the product and the bottom opening cam for opening the circular conveyor gripper to deposit the product onto the receiving device.

It has also been discovered that an inhibiting cam device, which controls the closing of the circular conveyor gripperas it receives the product, provides better control for receiving the product and avoids a tug of war between the line conveyor gripper and the circular conveyor gripper when the product is intended to be carried by the line conveyor to a subsequent receiving device more particularly, the inhibiting cam device is a rotatable assembly of a plurality of inhibiting cams which act on the circular conveyor gripper as it closes about the product and starts its downward movement to the stacker/bundler.

Additionally, it has been found that, if the bottom opening cam is adjustable as to the release point of the product, the bottom opening cam allows for a constant point of release of the product regardless of the thickness of the product.

Preferably, a copy stripper is mounted opposite the bundler/stacker so as to remove the product from the jaws of the circular conveyor gripper.

It is also preferred that one or more pans be employed adjacent to the circular conveyor but, downstream of the circular conveyor, so that, as the product is received from the line conveyor gripper, it is controlled during its movement downward to the receiving device Preferably, the receiving device employed with the transfer device of the present Invention is a bundler/stacker.

When the receiving device is a bundler/stacker, it is preferred that the stacking fork of the bundler/stacker have a homing sensor to permit automatic setting of the stacking fork relative to the circular conveyor.

These and other aspects of the present Invention will be more readily understood by reference to one or more of the following drawings.

DETAILED DESCRIPTION OF THE INVENTION

In the detailed description of the Invention, reference will be made to newspaper jackets or, more simply, jackets as the flat, flexible, non-self-supporting printed product. Additionally, reference will be made to a bundler/stacker as the receiving device. It will be understood that other receiving devices can be employed with the present Invention and that other products besides newspapers can be handled by the present Invention.

Figure 1:
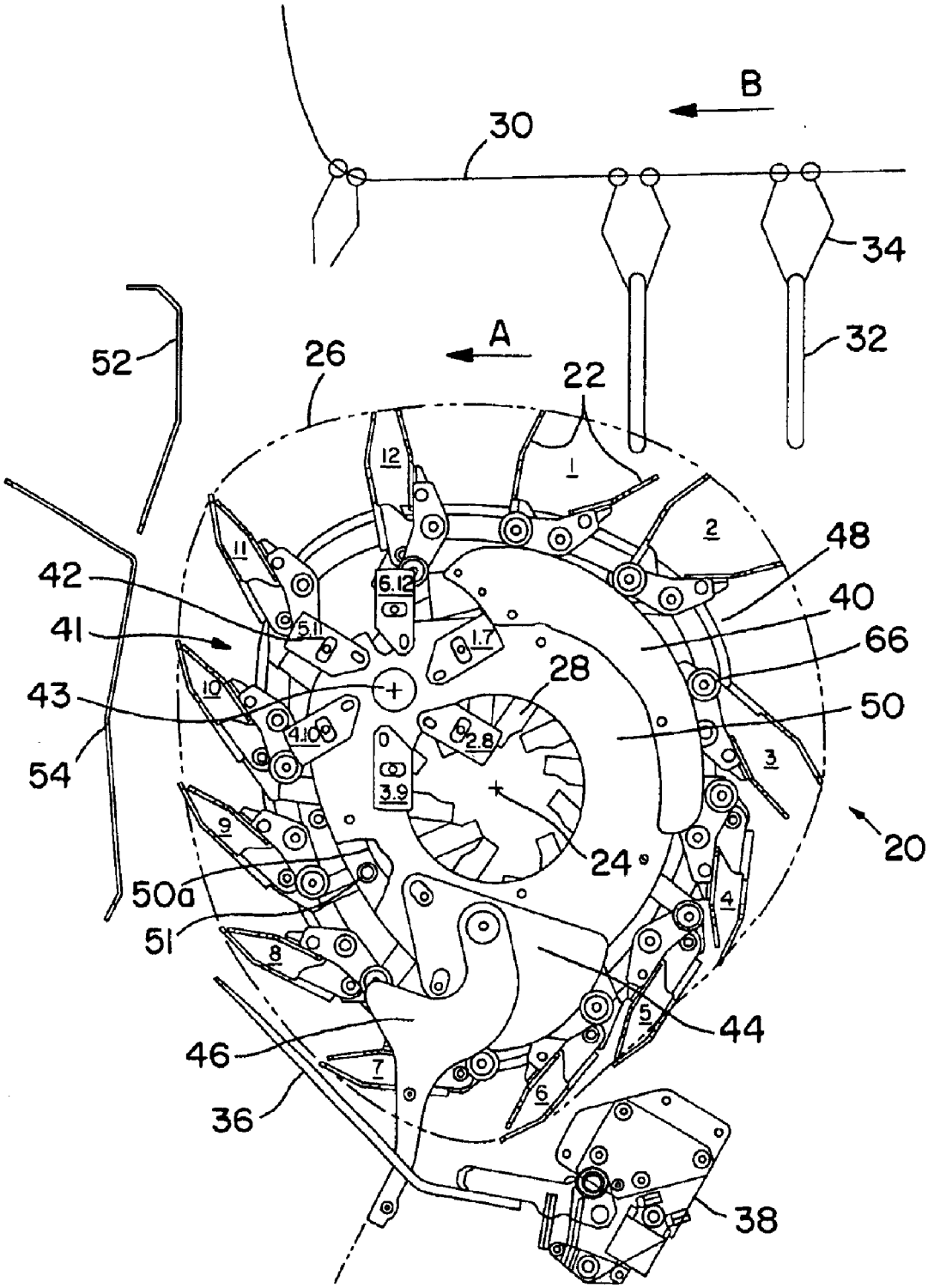
FIG. 1 is a side view of the transfer device of the present Invention employed as a bundler infeed device.

FIG. 1 illustrates a preferred embodiment of the transfer device of the present Invention employed as a bundler infeed device wherein a circular conveyor shown as gripper drum 20 has a plurality of circular conveyor grippers or drum grippers 22 positioned around its periphery. Drum grippers 22 have been numbered 1 through 12 to distinguish each from the other. Gripper drum 20 rotates about center of 24 in the direction of arrow A. Drum grippers 22 follow drum gripper tip path 26. Drum grippers 22 are mounted on slide 28 which provides the radial movement of drum grippers 22.

Drum grippers 22 are of a conventional construction having jaws which are spring biased in a closed position as shown by drum gripper No. 11, for example.

Gripper drum 20 is positioned below line conveyor 30. Line conveyor 30 has a plurality of line conveyor grippers 34 which hold jacket 32 of a newspaper. Conveyor 30 moves in the direction of arrow B.

Below gripper drum 20 is positioned articulating stacking fork 36 and its articulating mechanism 38. Drum grippers 22 receive jacket 32 and deposits jacket 32 onto fork 36, all this being accomplished by the rotation of gripper drum 20 in the direction of arrow A.

In order to open drum grippers 22 as they move to the top of the rotation of gripper drum 20, top opening cam 40 is fixed in position on the outside of gripper drum 20. As shown in FIG. 1, top opening cam 40 acts on gripper Nos. 1, 2, 3, and 4 as they rotate towards the top of their path of rotation. Top opening cam 40 operates on drum grippers 22 in a conventional manner by means of cam follower 66 which is part of each of drum grippers 22.

In order to control the closing and removal of jacket 32 from line conveyor gripper 34, inhibiting cam assembly 41 is used to control the closing of drum grippers 22 about jacket 32. Inhibiting cam assembly 41 employs a plurality of inhibiting cams 42 which rotate about center 43. As shown in FIG. 1, inhibiting cams 42 have been numbered to correspond with drum grippers 22 upon which they act. In other words, as shown in FIG. 1, inhibiting cam No. 6, 12 operates on drum gripper No. 12 and drum gripper No. 6. Likewise, inhibiting cam No. 5, 11 operates on drum gripper No. 11 and drum gripper No. 5. As will be appreciated, the number of inhibiting cams 42 is half the number of drum grippers 22. As also will be appreciated, inhibiting cam assembly 41 rotates twice around for each rotation of gripper drum 20.

As jacket 32 is carried to the bottom of the rotational cycle of gripper drum 20, bottom opening cam 44 operates on cam follower 66 to open drum gripper 22 and allow jacket 32 to be deposited on articulating stacking fork 36 or the stack of jackets 32 which are on stacking fork 36. Bottom opening cam 44 is adjustable to accommodate different thickness of newspaper and functions in a conventional manner by forcing one of the jaws away from the other.

In order to assist in the depositing jacket 32 under fork 36, copy stripper 46 is employed. Copy stripper 46 is a conventional piece of equipment which is employed in a conventional manner in order to assist in a speedy removal of jacket 32 onto fork 36. In FIG. 1, only one cam follower 51 is illustrated for drum gripper No. 9 in a breakaway portion of FIG. 1. The non-circular movement of the drum grippers 22 is provided by cam surface 50*a* on cam follower 51. The radial motion of drum gripper 22 is illustrated by drum gripper tip path 26. As can be seen, this path is somewhat flat at the top of rotation of drum 20, such that the line of travel of drum gripper 22 is approximately parallel to the line of travel of line conveyor gripper 34. This aids in avoiding a tug-of-war and aids in a smooth transition of jacket 32 from line conveyor gripper 34 to drum gripper 22.

The radial motion of drum gripper 22 is also evident in the downward path of drum gripper 22 wherein the downward path of drum gripper 22 is approximately vertically downward as shown in FIG. 1.

Furthermore, the radial movement of drum gripper 22 is seen at the area of contact between drum gripper 22 and stacking fork 36. By having the line of travel of drum gripper 22 approximately parallel to the flat surface of fork 36, a smooth transition between the circular conveyor and the bundler is obtained.

Additionally, by employing radial movement for drum gripper 22, a space savings is obtained. Obviously, an approximate parallel line of travel between line conveyor 30 and drum gripper 22, and fork 36 and drum gripper 22, can be obtained if the diameter of drum 20 is very large. Radial movement of drum gripper 22 allows for a smaller diameter drum while still obtaining relatively parallel movement.

Radial cam 50 is employed to act on a cam follower 51 mounted on each slide 28 to provide radial movement of drum gripper 22.

In order to control the movement of jacket 32 during its downward decent from line conveyor 30 to fork 36, upper pan 52 and lower pan 54 are employed. As will be appreciated, drum grippers 22 grabs the bottom edge of jacket 32 while pans 52 and 54 help maintain the top edge of jacket 32 in an upward direction during its downward movement. This assists in preventing inserts, which are in jacket 32, from escaping. The distance, which pans 52 and 54 are spaced from tip path 26, depends primarily on the size or dimension of jacket 32.

As will be appreciated, FIG. 1 does not illustrate the framework which is associated with the various elements. Such framework is conventional and is employed to maintain the relative position of the various elements.

Also, as will be understood, fork 36 and its associated articulated mechanism 38 is movable so as to move the stack of jackets 32 away from gripper drum 20 as the stack grows and to allow an empty fork 36 to be positioned in place. The stack, which is formed on fork 36, can either be stored for future use or banded in a conventional manner for shipment. Both stacking fork 36 and its associated mechanism 38, as well as a banding mechanism, are conventional.

Figure 2:
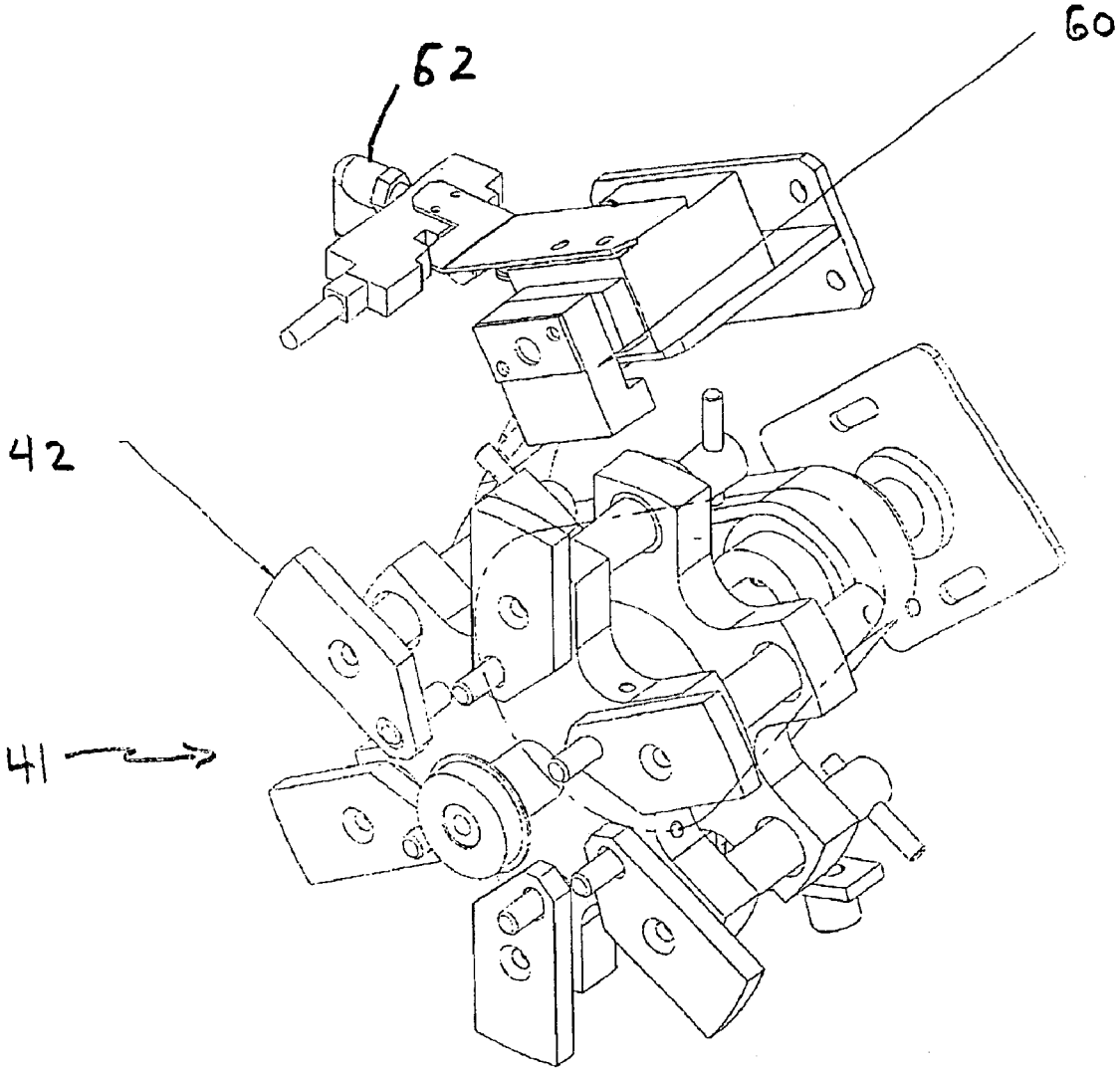
FIG. 2 is a perspective view of the inhibiting cam assembly.
Figure 3:
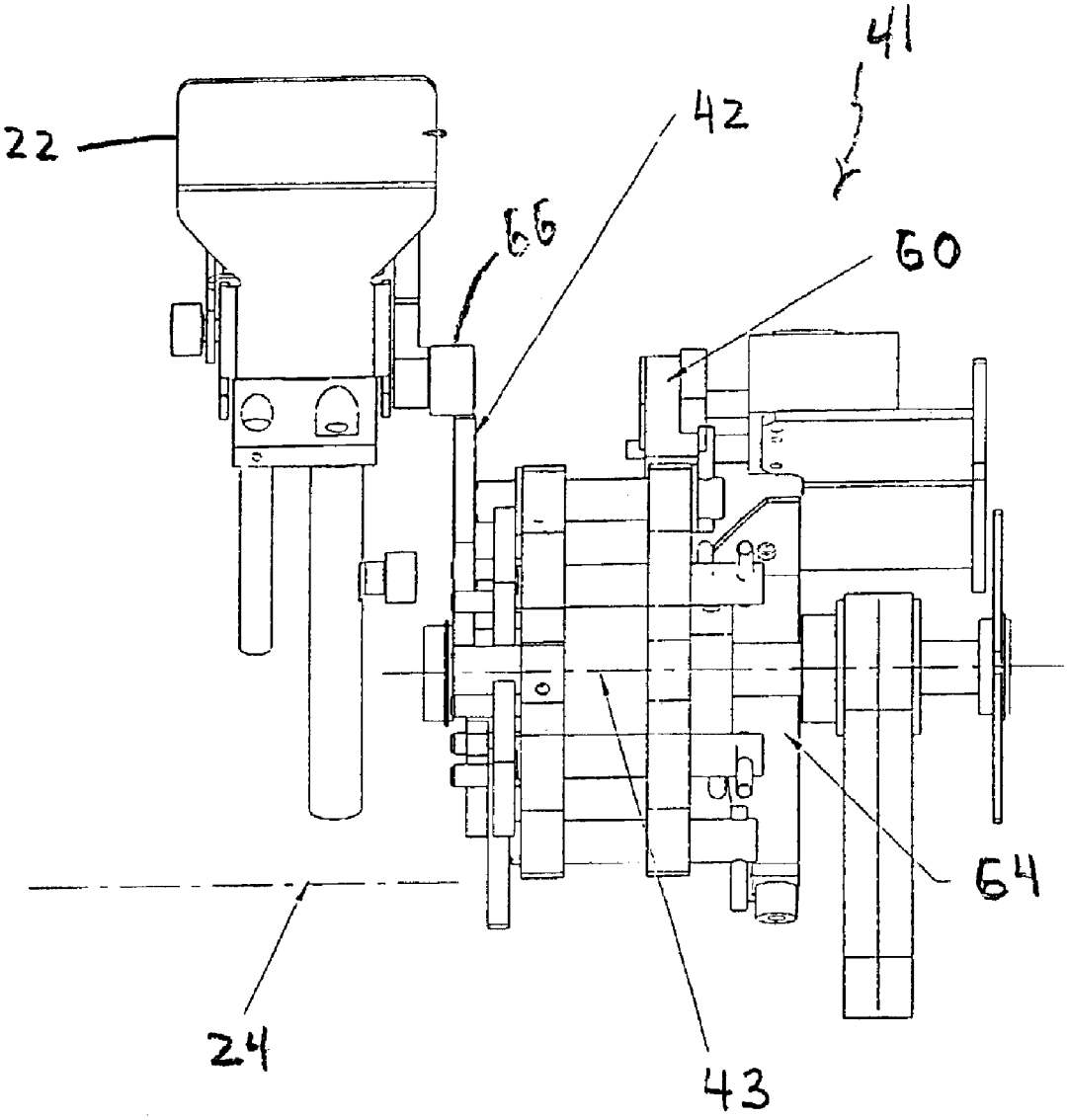
FIG. 3 is a front view of the inhibitor cam assembly and a circular conveyor gripper shown in inhibited position.
Figure 5:
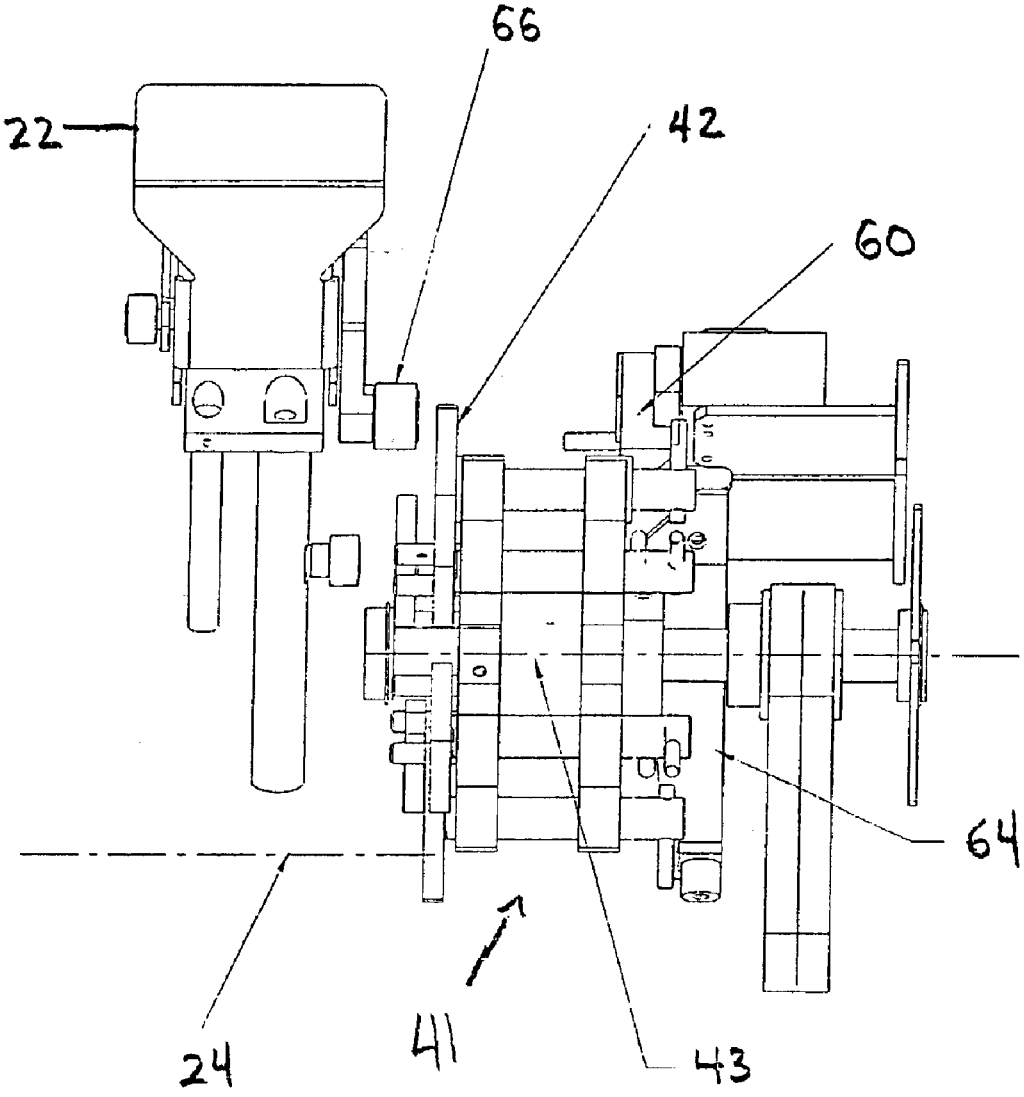
FIG. 5 is a front view of the circular conveyor gripper and inhibited assembly showing the circular conveyor gripper uninhibited.
Figure 6:
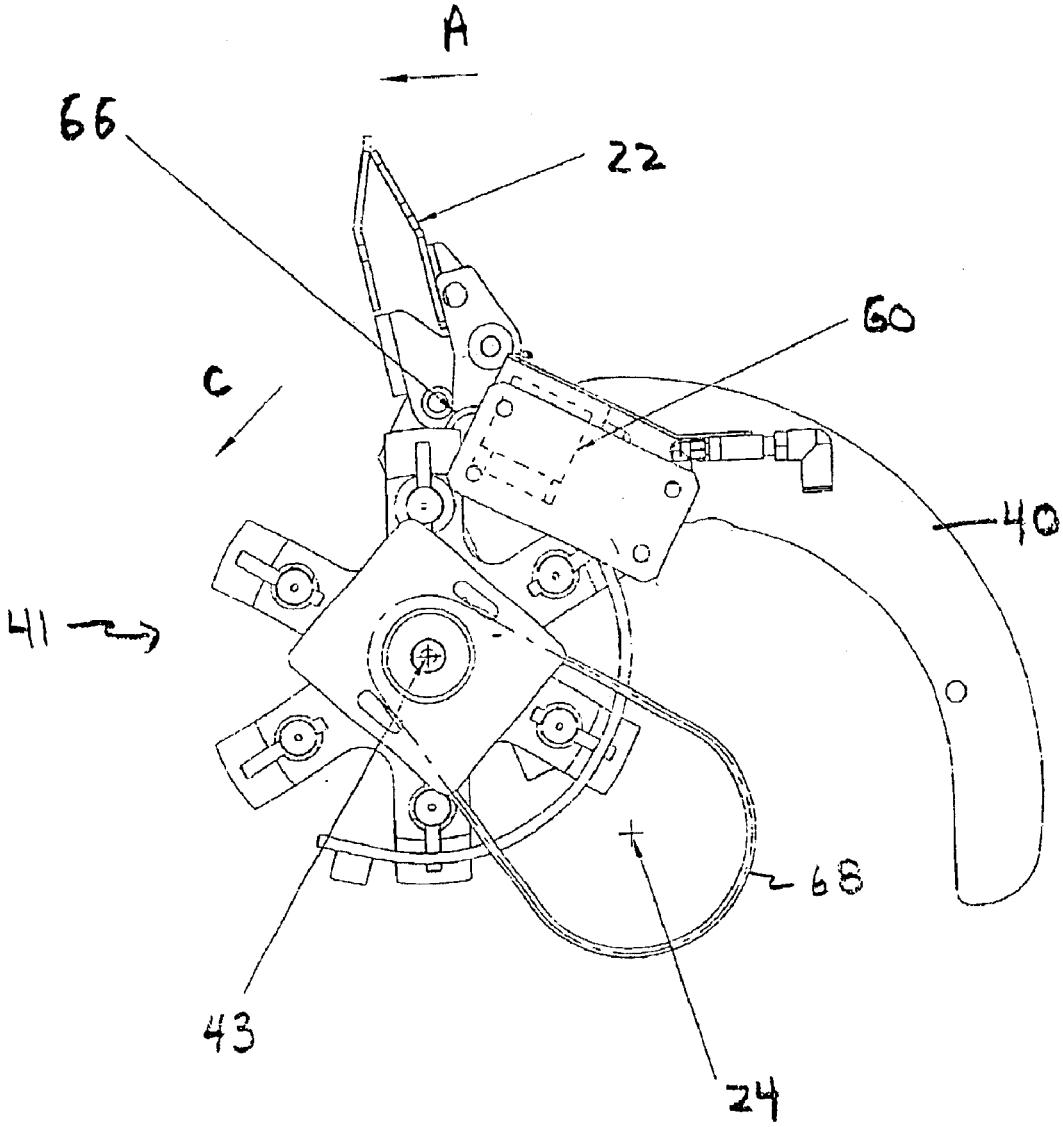
FIG. 6 is a side view of FIG. 5.
Figure 8:
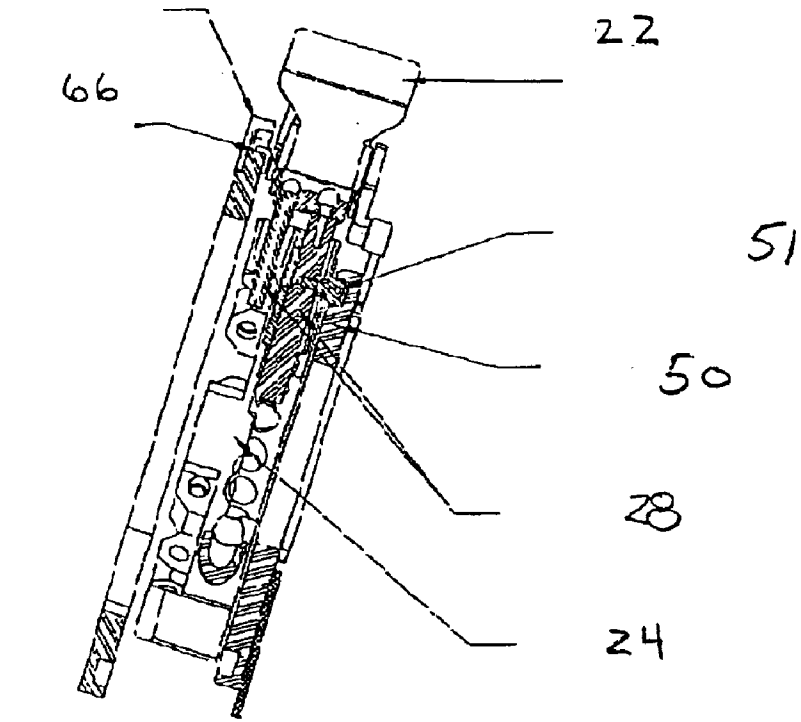
FIG. 8 illustrates a cross section of the device taken along line A—A of FIG. 7.
Figure 7:
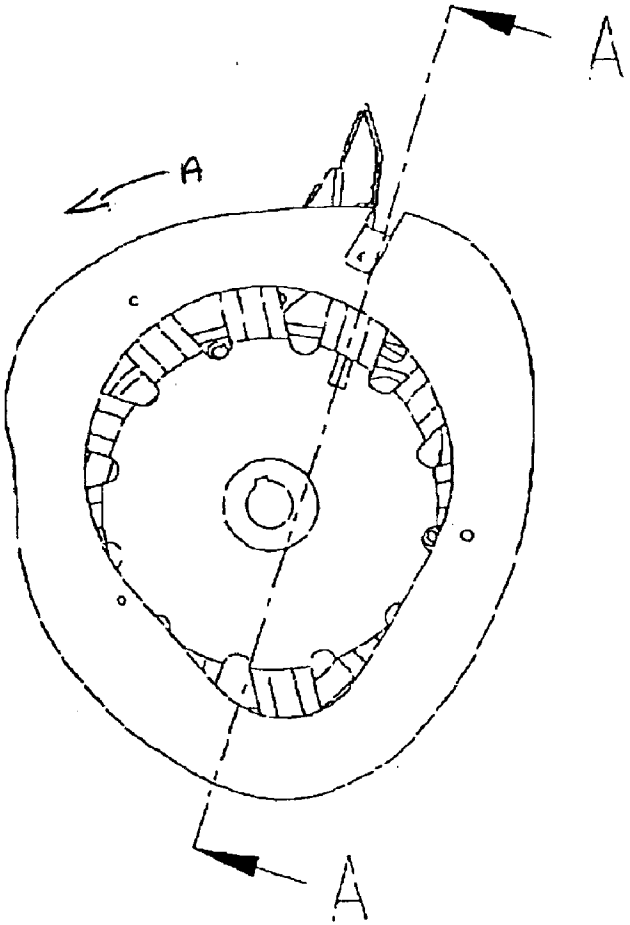
FIG. 7 illustrates a side view of the device of FIG. 1.

Turning to FIG. 2, details of the inhibitor cam assembly 41 are illustrated in a perspective view. As shown in FIG. 2, there are six inhibitor cams 42 which are part of assembly 41. Enabling cam 60, which is shown in the retracted position in FIG. 2, is retracted by fluid activation from valve 62 as shown in FIG. 5. In the retracted position, enabler cam 60 is retracted. Enabling cam 60 is spring loaded to be in an extended state as shown in FIG. 3 without activation from air via fluid valve 62. When enabling cam 60 is retracted, inhibiting cams 42 are in position to allow closing of drum gripper 22 by acting on cam follower 66. Thus, opening and closing of drum grippers 22 is controlled via valve 62.

Turning to FIG. 3, FIG. 3 illustrates enabling cam 60 in an extended position which, in turn, shows inhibitor cam 42 extended into the path of gripper cam follower 66. With gripper cam follower 66 acted upon by inhibitor cam 42, drum gripper 22 is maintained in a slightly open position as shown by drum gripper No. 12 in FIG. 1.

Reset cam 64 operates on all inhibitor cam 42 to move them to the extended or inhibiting position as shown in FIG.

3. This is the natural or rest position of inhibitor cam 42. When inhibitor cam 42 is retracted, it moves to right in FIG. 3, gripper cam follower 66 is no longer acted upon by inhibitor cam 42 and drum gripper 22 can close on jacket 32, as shown in FIG. 5.

Figure 4:
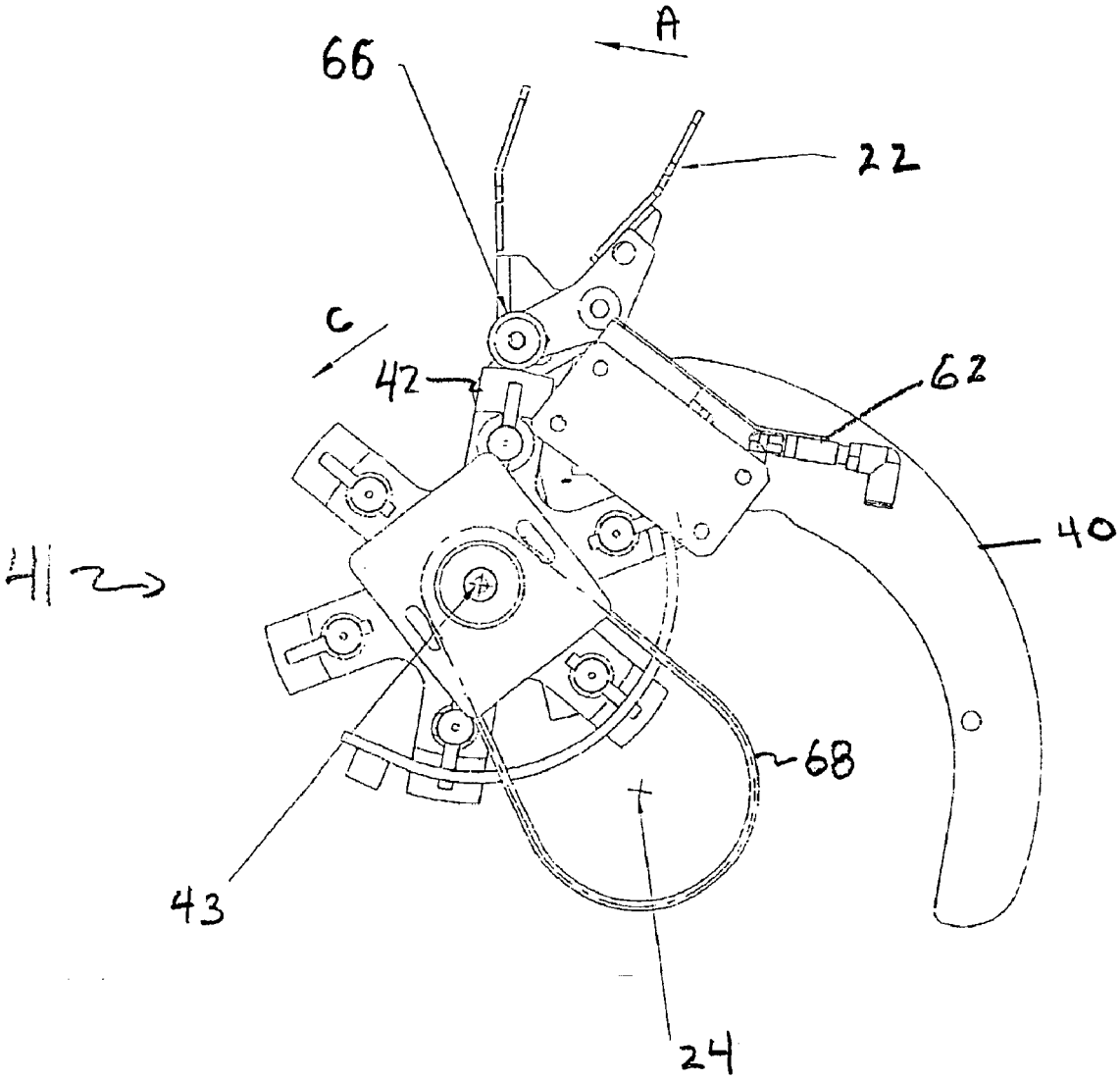
FIG. 4 is a side view of FIG. 3.

FIG. 4 illustrates drum gripper 22 and inhibitor cam assembly 41, as shown in FIG. 3, wherein inhibitor cam 42 is operating on cam follower 66 to maintain drum gripper 22 in a slightly open position.

As shown in FIG. 4, drum gripper 22 follows the rotation as indicated by arrow A while inhibitor cam 42 rotates about center 43 and moves in the direction of arrow C. As will be appreciated, inhibitor cam assembly 41 is operated by belt 68 which is operated upon the axle that drives gripper drum 20. As will be appreciated by one of skill in the art, inhibitor cam assembly 41 can be independently driven, however, it is suitable that a standard servo drive be employed so as to coordinate, not only the movement of gripper drum 20 with respect to conveyor 30, but also to coordinate the movement of inhibitor assembly 41 and gripper drum 20.

Turning to FIG. 5, enable cam 60 is shown in the retracted state which, in turn, allows inhibitor cam 42 to be in the retracted state and out of the path of cam follower 66. In such an arrangement, drum gripper 22 closes so as to hold jacket 32 tightly between its jaws. Referring back to FIG. 1, this is the position of gripper No. 10 which is shown leaving the area of operation of inhibiting cam assembly 41 on its downward movement towards fork 36.

By controlling the opening and closing of drum grippers 22 with inhibitor cam assembly 41, selected jackets 32 can bypass one device of the present Invention and pass to a subsequent transfer device.

While only a limited number of specific embodiments of the present Invention have been expressly disclosed, it is, nonetheless, to be broadly construed and not to be limited except by the claims appended hereto.

What is claimed is:

1. A transfer device for feeding a plurality of flat flexible, non-self-supporting products received serially from a line conveyor to a receiving device, said line conveyor having a plurality of line conveyor grippers each of which holds one of said products from a top edge thereby allowing said products to hang, said transfer device comprising:

a circular conveyor mounted below said line conveyor and above said receiving device;

a plurality of circular conveyor grippers, each mounted on a slide, said slide being movable in a radial direction, said circular conveyor grippers having jaws which open and close in a controlled manner to grip a bottom edge of said products as said line conveyor passes over said circular conveyor, said circular conveyor grippers release said products to said receiving device at the bottom of rotation of said circular conveyor; and a radial cam that operates on a cam follower mounted on said slide to provide each of said circular conveyor grippers with radial movement, wherein said receiving device is a bundler which has an articulating fork positioned below said circular conveyor for sequentially receiving said packages.

2. The device of claim 1 wherein said products are newspapers.

3. A transfer device for feeding a plurality of flat flexible, non-self-supporting products received serially from a line conveyor to a receiving device, said line conveyor having a plurality of line conveyor grippers each of which holds one of said products from a top edge thereby allowing said products to hang, said transfer device comprising:

a circular conveyor mounted below said line conveyor and above said receiving device;

a plurality of circular conveyor grippers, each mounted on a slide, said slide being movable in a radial direction, said circular conveyor grippers having jaws which open and close in a controlled manner to grip a bottom edge of said products as said line conveyor passes over said circular conveyor, said circular conveyor grippers release said products to said receiving device at the bottom of rotation of said circular conveyor; and a radial cam that operates on a cam follower mounted on said slide to provide each of said circular conveyor grippers with radial movement, wherein the opening and closing of the circular conveyor grippers is controlled by:

a top opening cam fixed onto the top of said circular conveyor and stationary with respect to the movement of said circular conveyor grippers to open said circular conveyor grippers to accept the bottom edge of said package from said conveyors;

a plurality of inhibiting cams rotatably mounted downstream of said top opening cam so as to inhibit the closing of said circular conveyor grippers as they close upon the bottom edge of said package thereby controlling the manner in which said circular conveyor gripper grips the package; and a bottom opening cam adjustably mounted at the bottom of said circular conveyor adjacent to said bundler so as to open said circular conveyor grippers to allow said package to be discharged onto said receiving device.

4. The device of claim 3 wherein said products are newspapers.

5. A transfer device for feeding a plurality of flat flexible, non-self-supporting products received serially from a line conveyor to a receiving device, said line conveyor having a plurality of line conveyor grippers each of which holds one of said products from a top edge thereby allowing said products to hang, said transfer device comprising:

a circular conveyor mounted below said line conveyor and above said receiving device;

a plurality of circular conveyor grippers, each mounted on a slide, said slide being movable in a radial direction, said circular conveyor grippers having jaws which open and close in a controlled manner to grip a bottom edge of said products as said line conveyor passes over said circular conveyor, said circular conveyor grippers release said products to said receiving device at the bottom of rotation of said circular conveyor;

a radial cam that operates on a cam follower mounted on said slide to provide each of said circular conveyor grippers with radial movement; and at least one pan mounted downstream of said circular conveyor and in close proximity with said circular conveyor such that the top edge of said package contacts said pan as said package is moved by said circular conveyor from said line conveyor to said receiving device.

6. The device of claim 5 wherein said products are newspapers.

* * * * *